US007140521B2

(12) United States Patent
Kapaj et al.

(10) Patent No.: US 7,140,521 B2
(45) Date of Patent: Nov. 28, 2006

(54) NOZZLE FOR CONTINUOUS CASTING

(75) Inventors: Nuredin Kapaj, Udine (IT); Milorad Pavlicevic, Udine (IT); Alfredo Poloni, Fogliano Redipuglia (IT); Fabio Vecchiet, Villa Vicentina (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 10/220,941

(22) PCT Filed: Mar. 7, 2001

(86) PCT No.: PCT/EP01/02540

§ 371 (c)(1),
(2), (4) Date: Nov. 21, 2002

(87) PCT Pub. No.: WO01/66286

PCT Pub. Date: Sep. 13, 2001

(65) Prior Publication Data

US 2003/0141324 A1 Jul. 31, 2003

(30) Foreign Application Priority Data

Mar. 8, 2000 (IT) ..... MI2000A0458

(51) Int. Cl.
*C21C 5/42* (2006.01)

(52) U.S. Cl. ..... 222/606; 222/594; 164/437; 164/337

(58) Field of Classification Search ..... 222/606, 222/594; 164/437, 337
See application file for complete search history.

(56) References Cited

U.S. PATENT DOCUMENTS

| | | | | |
|---|---|---|---|---|
| 3,995,682 | A * | 12/1976 | Fekete et al. | 164/437 |
| 5,227,078 | A * | 7/1993 | Augustine, III | 222/606 |
| 5,673,857 | A | 10/1997 | Meroni et al. | |

FOREIGN PATENT DOCUMENTS

| | | |
|---|---|---|
| BE | 818942 | 8/1993 |
| EP | 0 685 282 A1 | 12/1995 |
| FR | 2 243 043 | 4/1975 |
| WO | WO 98/14292 | 4/1998 |

OTHER PUBLICATIONS

Notification of Transmittal of International Preliminary Examination Report for PCT/EP01/02540 dated Feb. 22, 2002.
International Search Report for PCT/EP01/02540 dated Jul. 16, 2001.

* cited by examiner

*Primary Examiner*—Scott Kastler
(74) *Attorney, Agent, or Firm*—Abelman, Frayne & Schwab

(57) ABSTRACT

An arrangement and conformation of the discharge openings and channels of a continuous-casting nozzle, together with a specific external profile of the body of the nozzle itself, enable slabs of any thickness, in particular from medium to thin ones, to be cast, which have excellent surface quality and are practically free from inclusions and blowholes.

16 Claims, 2 Drawing Sheets

NOZZLE FOR CONTINUOUS CASTING

FIELD OF THE INVENTION

The present invention refers to an improved nozzle for continuous casting, and more precisely refers to a nozzle suitable for casting slabs, in particular slabs of small and medium thickness, with high casting rates and improved surface and internal quality of the cast slabs.

STATE OF THE ART

As is known, continuous casting of metals and metallic alloys, in particular steel, consists in transferring, via a refractory material duct referred to as "nozzle", the molten metal from a first container, called "tundish", having the function of distributor and equaliser of the flow, into a second bottomless container, called "ingot mould" or "crystallizer", which is strongly cooled by means of water circulation. At the start of casting, the crystallizer is closed at the bottom by a mobile body referred to as "dummy bar". The molten metal contained in the crystallizer is protected from oxidation at high temperature by means of a layer of lubricating powder, which is continuously renewed. As soon as a sufficient amount of solidified metal has formed inside the crystallizer, along the walls of the crystallizer and of the dummy bar, the latter is extracted together with the solidified metal in the form of a shell or skin still containing liquid metal. The liquefied lubricating powder which floats on the molten metal works its way between the solidified skin and the walls of the crystallizer, so diminishing friction. Once outside of the crystallizer, the extracted body undergoes further cooling, until it is completely solidified, and it is then cut into slabs of convenient length, which are sent on for further processing.

Continuous casting has become the casting method most widely used at an industrial level. This is due to numerous factors, and in particular to the fact of having available a cast body with a more suitable shape for the subsequent processes than that of ingots, as well as with a theoretically infinite length, so that it is consequently possible to markedly reduce any defects and/or rejects due to segregation, presence of inclusions, pipes, and the like, which are inherent in the more traditional ingot casting.

Continuous-casting technology has undergone numerous improvements over time, in particular linked to the casting rate and to internal and surface defects of the cast products. This latter aspect is particularly important. In fact, such defects reflect on the surface finish of the end product, which in many cases has to be impeccable, as e.g. for carbon-steel coils for car bodies, or for stainless-steel coils for architectural or aesthetic uses (decorative panels, kitchen-sink surfaces, cooking surfaces, pots and pans, etc.)), or even on the mechanichanical characteristics of the finished product (for example, excessive susceptibility to work hardening; reduced tensile strength and/or resilience, etc.).

Among the factors affecting the defectiveness of cast products are included the thermal, mechanical and fluid-dynamic conditions of the liquid metal in the ingot mould at the level of the initial solidification of the skin. In fact, the molten metal coming from the nozzle has higher speed and temperature than those of the metal present in the crystallizer, in which consequently convective currents are set up that can, among other things, draw particles of the supernatant lubricating powders into the body of the liquid metal and up to the viscous zone of start of solidification, with the consequent formation of inclusions, as well as causing sharp differences in temperature inside the metal such as to induce variations of thickness of the solidifying skin. A further source of defects is represented by the fact that little circulation of molten metal is possible between the mouth of the nozzle and the layer of supernatant lubricating powder, with the result that the latter may not melt adequately, i.e., in such a way as to guarantee the necessary lubrication between the skin that is forming and the walls of the crystallizer.

The above situation worsens considerably in the markedly expanding field of the medium and low thickness slab casting, i.e. slabs having a thickness of less than 150 mm, in particular less than 90 mm, where the disturbance due to entry of the jet of molten metal from the nozzle into the crystallizer is notably increased.

One of the possible solutions to such problems is to improve the geometry of nozzles. In fact, nozzles were originally simply rectilinear pipes having the bottom discharging end immersed in the liquid metal present in the crystallizer. This structure generated in the crystallizer strong currents of molten metal directed practically only downwards, with irregular recirculation returning upwards along the walls of the crystallizer. The inadequacy of such a situation was soon recognized. Consequently, the immersed part of nozzles has undergone numerous modifications, which basically have involved the creation of holes with horizontal axes or with axes facing downwards, in the end part of the nozzle, which has remained essentially tubular. Further modifications to the immersed part have subsequently been adopted and have envisaged a chamber having a cross section greater than that of the nozzle. In this chamber discharging holes have been opened. With the knowledge acquired from such improvements, there has developed an ever-increasing awareness of the importance of the formation of patterns of liquid metal flow, as the liquid metal leaves the nozzle, which must have appropriate shapes, dimensions and rates that may even be different from one another.

Along such a line, the published French patent application FR-A-2 243 043 describes a nozzle the end discharging part of which is provided with a rectangular section distribution chamber with wall parallel to the walls of the crystallizer, in which the liquid metal coming out of the nozzle encounters deflecting walls after a rectilinear path of at least 100 mm, and is sent on by these deflecting walls towards discharging holes with horizontal axes, or else with axes inclined downwards or upwards. However, the geometry of this nozzle only allows a limited diameter of the discharging holes. Consequently, jets of liquid metal having high speeds are formed, so maintaining the presence of the disturbance previously described. Below the nozzle inhomogeneous temperatures are moreover formed, which adversely affect the quality of the cast.

The Italian patent No. 1 267 242 in the name of the present applicant describes a nozzle consisting of a discharge duct having a first stretch with circular cross section which decreases regularly towards a second stretch, beneath it, with a cross section that varies from circular to basically that of an elongated rectangle, the lower part of the said second stretch being closed at the bottom by a wall and being provided with side openings along the shorter sides of the rectangular section. The said openings lead to a chamber which surrounds the bottom part of the said second stretch and has holes facing upwards and downwards. In this way, the molten metal supplies both the bottom part of the crystallizer, in which solidification of the metal starts, and the top part of the crystallizer. Each one of the jets of metal coming out of the chamber has a flow rate lower than the flow rate at each of the side openings present in the second stretch of the nozzle. In this way, the jets of metal directed downwards cause less disturbance of the thermal flows in the vicinity of the walls of the crystallizer, thus rendering the thickness of the skin that is forming more constant, whilst the jets directed upwards favour maintenance of high temperatures in the top part of the crystallizer, thereby ensuring complete melting of the lubricating powder used for protecting the molten metal and preventing the formation of "cold" spots, at which there could occur an undesirable solidification of the metal.

Experience has shown, however, that, albeit representing an improvement over previous nozzles, a nozzle having the above structure is, on the one hand, suitable only for continuous casting of thin slabs, whereas on the other it does not achieve completely the advantages set forth in the description. In particular, the problem remains, which is moreover common to all nozzles, of the poor feed of molten metal upwards in the region around the descending duct of the nozzle. In this region, the vicinity of the cooled walls of the crystallizer to the nozzle, combined with a poor circulation of the molten metal coming directly from the nozzle, and hence at maximum temperature, easily causes the formation of cold spots. In addition, the relatively low temperature around the nozzle may lead to the failure of the supernatant lubricating powder to melt in situ, with possible drawing along of solid particles of lubricating powder in the solidification zone.

SUMMARY OF THE INVENTION

The aim of the present invention is to overcome the drawbacks referred to above by proposing a nozzle for continuous casting of slabs preferably having a thickness of between 40 and 200 mm and a width of between 700 and 3200 mm. This purpose is achieved by the design of a nozzle which provides a plurality of discharging channels directed downwards and upwards, part of the channels directed upwards having walls with a winged profile; in addition, the section of said nozzle is appropriately variable in a continuous fashion. In this way, are obtained a first flow of liquid metal upwardly coming out of,the nozzle, said first flow lapping the descending duct of the nozzle itself, as well as a second flow upwardly directed towards the regions closest to the smaller walls of the crystallizer, and also a third low speed flow of liquid metal downwardly directed in such a way as to involve practically the entire section of the crystallizer.

With a number, configuration and arrangement of discharge channels of this sort, the upwardly directed flows of liquid metal have a low speed and are distributed uniformly over the entire section of the crystallizer, thus ensuring: (i) a good uniformity of temperature of the liquid metal at the level of the meniscus; (ii) a complete liquefaction of the lubricating powder; and (iii) the absence of vortices at the level of the meniscus, which might determine trapping of the lubricating powder.

On the other hand, also the downwards directed flows are uniform and relatively "gentle", so enabling any possible gas bubbles and inclusions drawn along by the liquid metal to return back up towards the meniscus. In addition, the direct impact of the jet of liquid metal against the skin that is solidifying is prevented, so eliminating, or at least markedly reducing, the so-called "washing" phenomenon.

DETAILED DESCRIPTION OF THE INVENTION

The present invention will now be described in detail with reference to the attached drawings, which show possible embodiments of the invention and in which.

Figure 3:
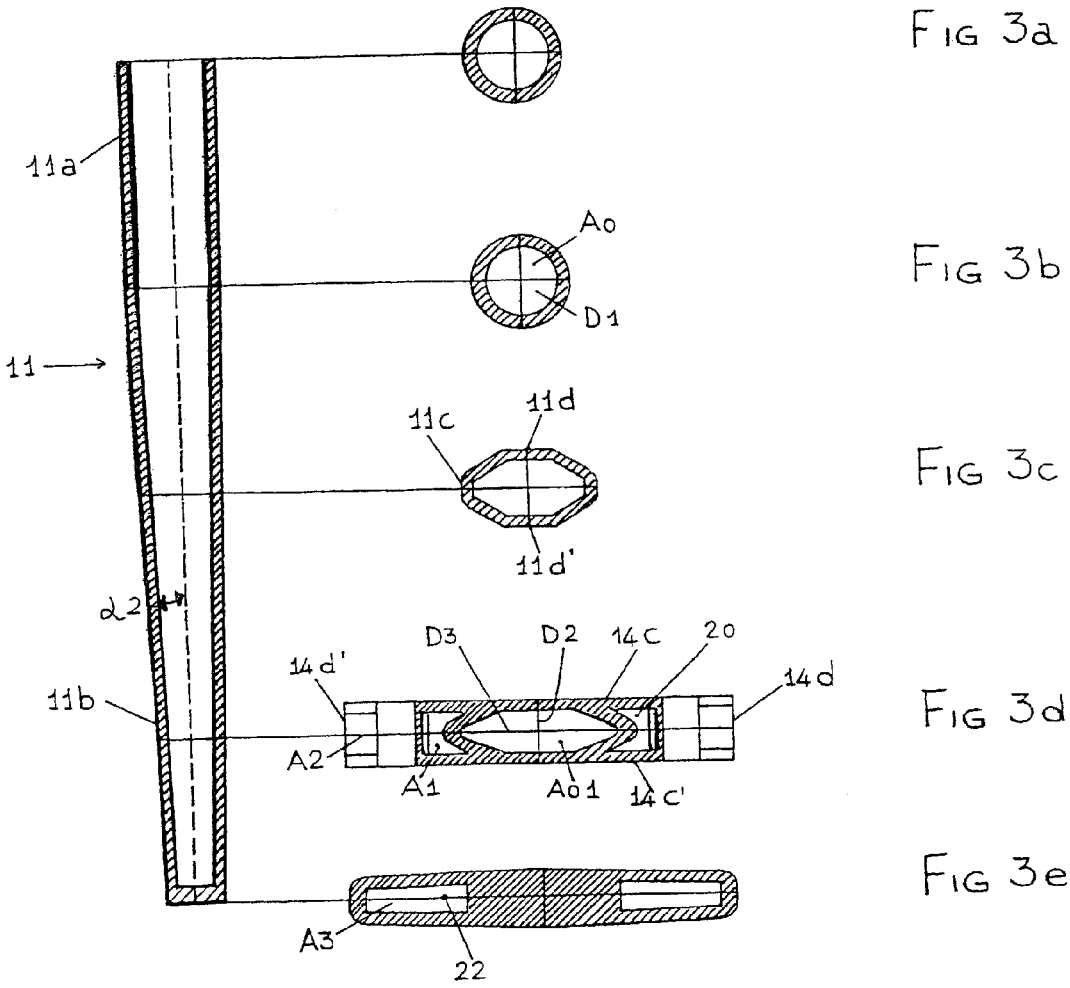
FIG. 3 is a longitudinal sectional view of the nozzle of FIG. 1, according to a plane orthogonal to the plane of FIG. 1.

FIGS. 3*a*–3*e* each show a cross section of the nozzle of FIG. 3.

In the figures, similar parts are identified by the same reference numbers; in addition, for reasons of simplicity, in one and the same figure with specular parts, some reference numbers are indicated in one of the parts and other reference numbers in the other. Finally, some of the reference numbers indicated in one figure may not be indicated in another figure, in order to prevent any reading mistakes. However, it is understood that the said reference numbers and indications are valid for all the similar figures.

Figure 2:
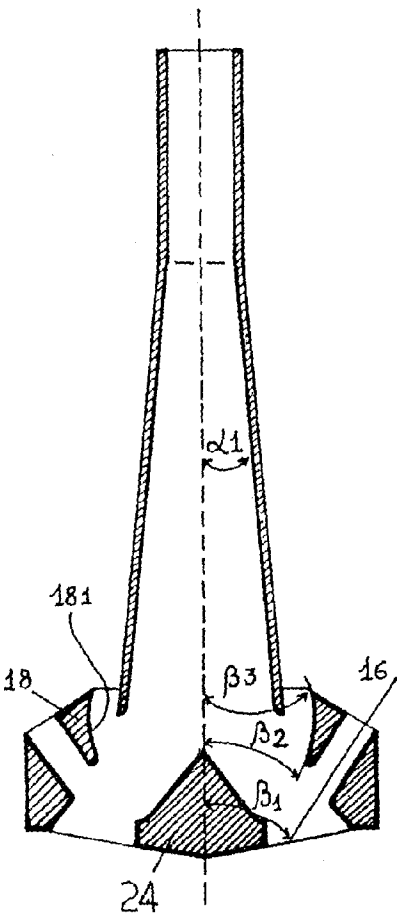
FIG. 2 is a longitudinal sectional view of a second embodiment of a nozzle according to the invention.
Figure 1:
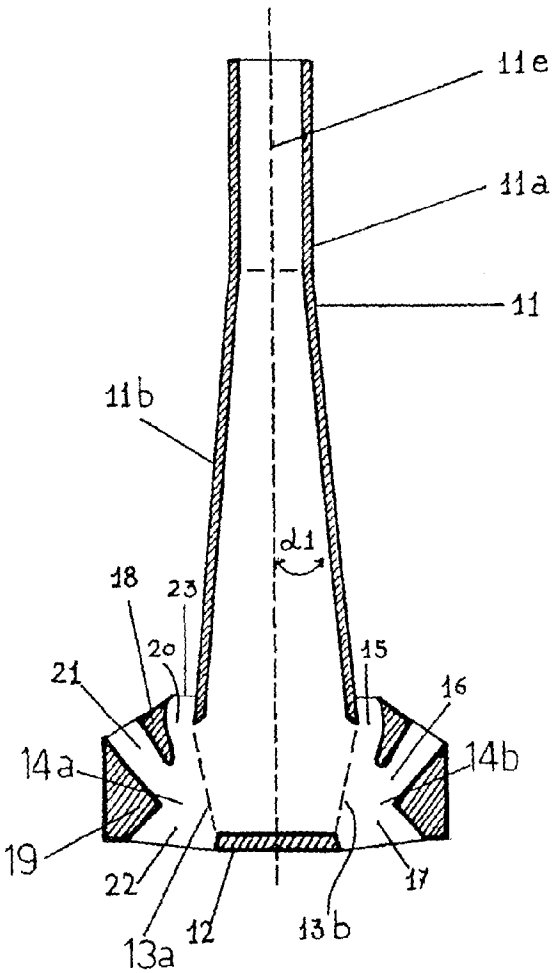
FIG. 1 is a longitudinal sectional view of a first embodiment of a nozzle according to the invention.

The nozzle according to the present invention is used for continuous feeding a liquid metal into a crystallizer for the continuous casting of slabs, preferably having a medium to small thickness, in which, in full operating conditions, a metal bath provided with a free surface referred to as meniscus, generally covered with lubricating covering powders, is present, and from which a body is continuously extracted, which is made up of a solidified skin still containing some solidifying metal. The nozzle is made up of an elongated tubular body 11 made of refractory material having a first top part 11*a* of a roughly cross section, and a second bottom part 11*b*, which is radiused to the first part and has a flattened cross section and roughly pointed end regions 11*c*, and is partially immersed in the metal bath and has, at the bottom, in each roughly pointed end region, a discharging hole 13*a*, 13*b*, the said second part further having, in its bottom end part, beneath the said discharging holes; a closing wall 12, which may be flat (FIG. 1), or else provided with a cusp 24 facing towards the inside of the nozzle (FIG. 2). Each of the said holes, which face one another, gives out into a laterally elongated chamber 14*a*, 14*b*, which is in turn provided with holes 20, 21, 22 to enable passage of liquid metal from the nozzle itself towards the inside of the crystallizer. The said bottom part 11*b* of the tubular body 11 made of refractory material may have a flattened polygonal cross section with rounded edges, or else an elliptical section, with opposite ends 11*c* that are roughly pointed, and each of said elongated chambers 14*a*, 14*b*, each defined by two larger walls 14*c*, 14*c*' and by deflecting elements 18, 19, is equipped with at least three discharging doors 20, 21, 22 designed to divide and distribute the jet of molten metal according to at least three preferential directions on each side of the nozzle, by means of said respective deflecting elements. In each of said chambers, at least two of the discharging doors are set facing upwards, and at least one of the discharging doors is set facing downwards, one of the doors facing upwards being adjacent to the said second bottom part of the tubular body and partially surrounding the pointed or edge-shaped end region 11*c* thereof, as illustrated in FIG. 3*d*.

In this way, preferential currents of molten metal are created, directed upwards and downwards. The doors 20 adjacent to the bottom part of the tubular body each have the shape of a duct with the longitudinal axis 15 preferably parallel or convergent upwards with respect to the longitudinal axis 11*e* of the nozzle 11, and with a face 181 having a winged profile with its concavity facing said tubular body. The end parts, bottom and top, of said face with winged profile form, respectively, leading angles β2 and trailing angles β3, with respect to the axis 11*e* of the nozzle, preferably between 0° and 45°, it being possible for said angles β2 and β3 to be equal to one another.

In this way, an upwardly directed metal jet is created which laps the outer walls of the nozzle along said edge 11*c* and which sends a jet of metal into the part of meniscus around the nozzle itself such as to guarantee uniformity of temperature with respect to the other regions of the meniscus.

At least one of said discharging doors facing upwards has the shape of a duct with a cross section that increases from the inside towards the outside, with a longitudinal axis diverging, by an angle β1 of between 10 and 80°, upwards with respect to the longitudinal axis of said elongated tubular body. In this way, a jet of liquid metal is generated directed towards the narrower walls of the crystallizer.

The combined action of the said upwardly directed jets of liquid metal supplies the top part of the bath present in the crystallizer, and hence its meniscus, in a considerably uniform manner, such as to maintain the entire region of the meniscus suitably hot, and so creating the ideal conditions for melting of the lubricating powder in order to diminish friction in the ingot mould, the said jets having, in any case, a relatively low speed, in such a way as to disturb as little as possible the flow of liquid metal circulating in the top part of the crystallizer.

Preferably, the deflecting elements 18, 19, which direct the jets of metal in the desired directions, constitute the elements of separation between contiguous discharging doors.

The said elongated tubular body 11 has a first stretch 11*a* with a section of constant area, and a second, lower, stretch, 11*b* having a section that increases in the direction of the said chambers 14*a* and 14*b* for distributing and discharging the metal. Preferably, the said first stretch 11*a* has a section of a circular type (FIG. 3*a*), whilst the second stretch 11*b* has a section that varies continuously from circular, at the point where it joins with the said first stretch (FIG. 3*b*), to an elongated flattened profile (FIG. 3*d*) in the vicinity of the said distributing and discharging chambers, it being possible for the said flattened profile to be, for instance, octagonal or elliptical.

In a preferred embodiment, the distance between the internal walls measured along the major internal axis D3, and the distance measured along the minor internal axis D2 of the section of the end part of the said second stretch are, respectively, greater and smaller than the internal diameter of the circular section. The angles α1 and α2 between the longitudinal axis of the nozzle and, respectively, the edge of said pointed end region of the flattened part of the nozzle and the face or region at 90° from the said edge, are, respectively preferentially between 2° and 8° and between 0° and 4°.

An essential aspect of the invention is that flows of metal having speeds and flow rates suited to the attainment of the required performance in terms of reduction in internal and surface defects and increase in plant output must be created.

For this purpose, the sections of the various passages present areas having appropriate ratios to each other.

In particular, the said second, bottom, tubular part 11*b* of the nozzle has a ratio between the internal area A01, at the level of the said distributing and discharging chambers, and the internal area A0, at the level of the join with said first top part, of between 1.1 and 1.7.

In addition, the ratio between the exit area A1 of each of the top discharging doors adjacent to the said second bottom part of the nozzle and the said area A01 is between 0.15 and 0.35, whilst the ratio between the exit area A2 of the other discharging doors facing upwards and the said area A01 is between 0.20 and 0.40.

As far as the doors facing downwards are concerned, for these the ratio between the exit area A3 and the said area A01 is between 0.15 and 0.75.

What is claimed is:

1. A nozzle for continuously feeding liquid metal into a crystallizer for continuous casting of slabs, the nozzle comprising:

a refractory elongated tubular body having:

a first top part having a substantially circular cross section; and a second bottom part, radiused to the first top part, having:

a substantially flattened section provided at a bottom portion thereof with lateral discharging holes; and a closing wall in a bottom end part thereof beneath the discharging holes, having a shaped selected from the group of flat and cusp-shaped facing the inside of the nozzle, wherein each of the discharge holes is set facing one another, opening out respectively into a laterally elongated chamber, in turn provided with channels for enabling passage of the liquid metal from the nozzle itself towards the inside of the crystallizer; and deflecting elements, wherein each of the elongated chambers is equipped with at least three discharging doors designed to divide and distribute a jet of liquid metal according to at least three preferential directions on each side of the nozzle, by the respective deflecting elements;

wherein two of the discharging doors on each side of the nozzle face upwards; and wherein at least one of the upwardly facing discharging doors on each side of the nozzle has the shape of a duct with a cross-section which increases from the inside outwards, with a longitudinal axis upwardly diverging by an angle $\beta_1$ between about 10° and about 80°, with respect to a longitudinal axis of the elongated tubular body.

2. The nozzle according to claim 1, wherein a bottom part of the elongated tubular body has a cross section selected from the group of elliptical and flattened round-edged polygonal profile with substantially lateral facing ends.

3. The nozzle according to claim 2, wherein angles α1 and α2 between the longitudinal axis of the nozzle and, respectively, an edge of a pointed end region of the flattened part of the nozzle and the face or region at about 90° from the edge are, respectively, within the preferential range of about 2° to about 8° and about 0° to about 4°, respectively.

4. The nozzle according to claim 1, wherein each of the elongated chambers is defined by two larger walls and by the deflecting elements.

5. The nozzle according to claim 1, wherein one of the upwards facing discharging doors on each side is adjacent to the bottom second part of the tubular body and partially surrounds the pointed or edged end region thereof.

6. The nozzle according to claim 1, wherein at least one of the discharging doors on each side is facing downwards.

7. The nozzle according to claim 1, wherein the doors adjacent to the bottom part of the tubular body each have the shape of a duct with longitudinal axis parallel or convergent, upwardly, to longitudinal axis of the nozzle, and with a winged profile face having a concavity facing the tubular body, the bottom and top end-parts of the face having, respectively, leading angles β2 and trailing angles β3 being between about 0° and about 45°.

8. The nozzle according to claim 7, wherein the angles β2, β3 are equal to one another.

9. The nozzle according to claim 1, wherein the elongated tubular body has a first stretch with a section of constant area, and a lower second stretch having a section which increases in the direction of the chambers for distributing and discharging the liquid metal.

10. The nozzle according to claim 9, wherein the first stretch has a circular section, and the second stretch has a continuously variable section, beginning from a circular profile, at the join with the first stretch, to an elongated flattened profile, in the vicinity of the distributing and discharging chambers, with the flattened profile being polygonal.

11. The nozzle according to claim 9, wherein the first stretch has a circular section, while the second stretch has a continuously variable section, beginning from a circular profile, at the join with the first stretch, to an elongated flattened profile, in the vicinity of the distributing and discharging chambers, with the flattened profile being elliptical.

12. The nozzle according to claim 11, wherein the distance between the internal walls measured along the major internal axis, and the distance measured along the minor internal axis of the section of the end part of the second stretch are, respectively, greater and smaller than the internal diameter of the circular section.

13. The nozzle according to claim 1, wherein the deflecting elements, which direct the jets of liquid metal in the desired directions, include regions of the refractory walls of the chambers and constitute a separation between contiguous discharging doors.

14. The nozzle according to claim 1, wherein the second tubular bottom part of the nozzle has a ratio between a first internal area at the level of the distributing and discharging chambers and a second internal area at the level of the joint with the first top part between about 1.1 and about 1.7.

15. The nozzle according to claim 1, wherein the ratio between the first exit area of each one of the top discharging doors adjacent to the second bottom part of the nozzle and a predetermined area is between about 0.15 and about 0.35, and the ratio between the second exit area of the first discharging doors facing upwards and the predetermined area is between about 0.20 and about 0.40.

16. The nozzle according to claim 1, wherein the ratio between the third exit area of the second doors facing downwards and the predetermined area is between about 0.15 and about 0.75.

* * * * *